US011312160B2

(12) United States Patent
Akama et al.

(10) Patent No.: US 11,312,160 B2
(45) Date of Patent: Apr. 26, 2022

(54) RECORDING APPARATUS

(71) Applicant: SEIKO EPSON CORPORATION, Tokyo (JP)

(72) Inventors: Junki Akama, Shiojiri (JP); Atsuhiko Takeuchi, Matsumoto (JP); Ryuji Moriyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/128,699

(22) Filed: Dec. 21, 2020

(65) Prior Publication Data

US 2021/0197587 A1 Jul. 1, 2021

(30) Foreign Application Priority Data

Dec. 25, 2019 (JP) ..... JP2019-234108

(51) Int. Cl.
*B41J 11/06* (2006.01)
*B41J 11/02* (2006.01)
*B41J 11/00* (2006.01)

(52) U.S. Cl.
CPC ..... *B41J 11/06* (2013.01); *B41J 11/0045* (2013.01); *B41J 11/02* (2013.01)

(58) Field of Classification Search
CPC ..... B41J 11/06; B41J 11/02; B41J 11/0045
See application file for complete search history.

(56) References Cited

U.S. PATENT DOCUMENTS 7,416,296 B2 * 8/2008 Takeda ..... B41J 11/06 347/104
9,180,694 B2 * 11/2015 Yoshino ..... B41J 11/06
2015/0165791 A1 6/2015 Yoshino et al.

FOREIGN PATENT DOCUMENTS

JP 2015-112802 6/2015

* cited by examiner

*Primary Examiner* — Henok D Legesse
(74) *Attorney, Agent, or Firm* — Workman Nydegger

(57) ABSTRACT

A recording apparatus includes a recording head configured to discharge a liquid onto a medium being transported in a transport direction, a platen disposed facing the recording head, and supporting the medium at a front face side, and a reinforcing member of a plate-like shape supporting the platen, in which the reinforcing member includes a first plate portion having a first face facing a back face of the platen, and a second plate portion bent, with respect to the first plate portion, in a direction intersecting the transport direction and opposite to the platen, in which a convex portion protruding from a side of the first face toward the platen is provided at an edge portion of a bent section between the first plate portion and the second plate portion, and the platen is supported at a top portion of the convex portion.

4 Claims, 9 Drawing Sheets

RECORDING APPARATUS

The present application is based on, and claims priority from JP application Serial Number 2019-234108, filed Dec. 25, 2019, the disclosure of which is hereby incorporated by reference herein in its entirety.

BACKGROUND

1. Technical Field

The present disclosure relates to a recording device.

2. Related Art

In the related art, a recording apparatus is known, which includes a medium support member supporting a recording medium, and a reinforcing member supporting the medium support member, as described in JP 2015-112802 A. In the recording apparatus, a hook provided at the medium support member is inserted through a hole provided at a top face of the reinforcing member, to thus attach the medium support member to the reinforcing member.

Unfortunately, in a configuration in which the medium support member is attached to the reinforcing member in a state of restricting mutual movement of the medium support member and the reinforcing member, there is an issue in that, when, for example, warpage occurs at the reinforcing member, the medium support member is also warped in conjunction with the warpage of the reinforcing member, which makes it difficult to secure accuracy in a height direction of the medium support member.

SUMMARY

A recording apparatus includes a recording head configured to discharge a liquid onto a medium being transported in a transport direction, a platen disposed facing the recording head, and supporting the medium at a front face side, and a reinforcing member of a plate-like shape supporting the platen, in which the reinforcing member includes a first plate portion having a first face facing a back face of the platen, and a second plate portion bent, with respect to the first plate portion, in a direction intersecting the transport direction and opposite to the platen, in which a convex portion protruding from a side of the first face toward the platen is provided at an edge portion of a bent section between the first plate portion and the second plate portion, and the platen is supported at a top portion of the convex portion.

DESCRIPTION OF EXEMPLARY EMBODIMENTS

Figure 1:
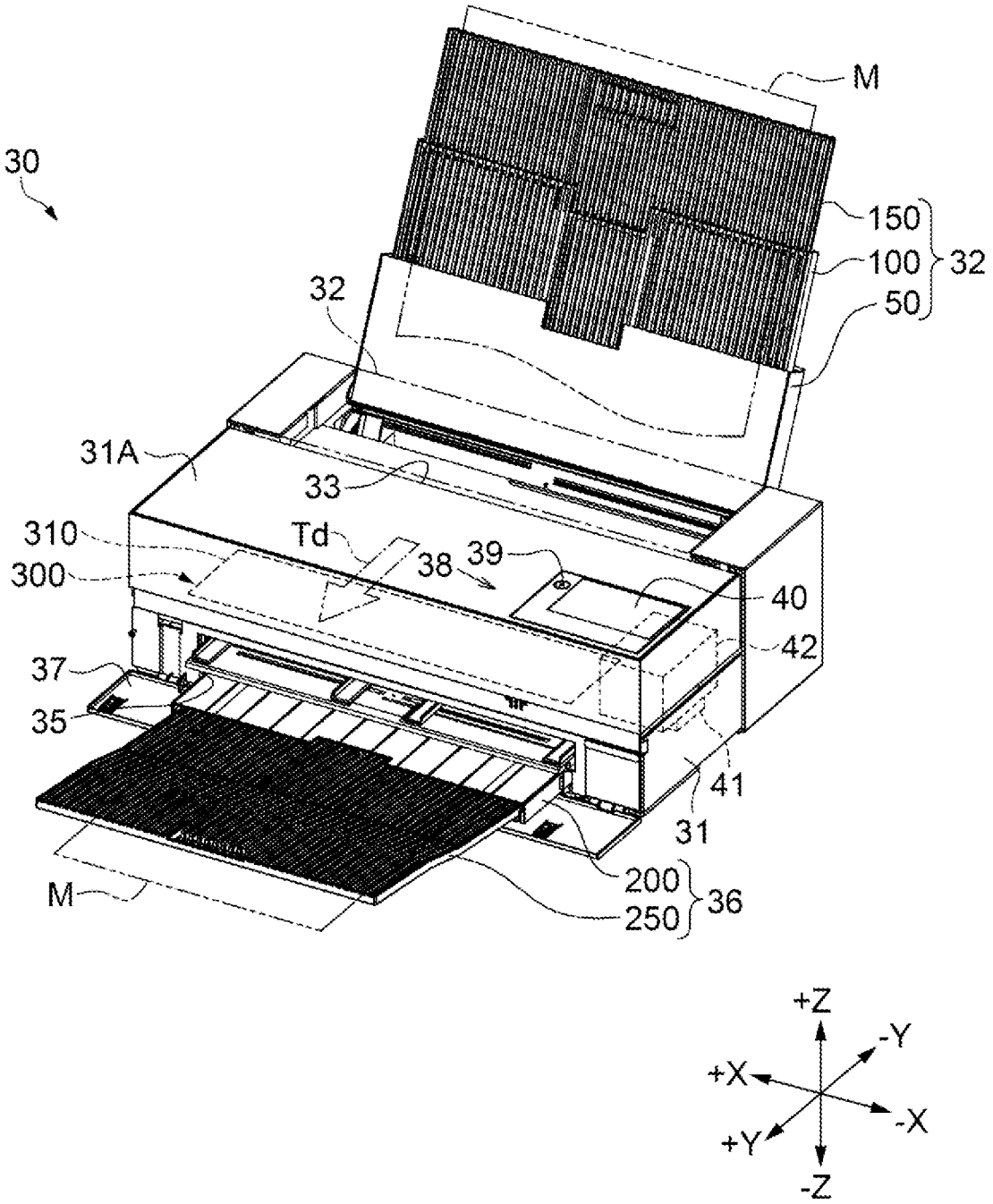
FIG. 1 is a perspective view illustrating a configuration of a recording apparatus.

A recording apparatus 30 illustrated in FIG. 1 serves as an inkjet printer of a serial printing type. The recording apparatus 30 includes a housing 31 of a substantially rectangular parallelepiped shape. An upper face 31A in a+Z direction of the housing 31 of the recording apparatus 30 is provided with a feeding tray 32 in which a user is allowed to set a paper sheet M as a medium on which recording is to be performed. The paper sheet M set in the feeding tray 32 is fed, through a feeding port 33, into the housing 31 of the recording apparatus 30.

The front in a+Y direction of the housing 31 of the recording apparatus 30 is provided with an ejection port 35 through which the paper sheet M, on which recording has been performed by the recording apparatus 30, is ejected, and an ejection tray 36 in which the paper sheet M on which the recording has been performed, ejected through the ejection port 35, is loaded. Note that a lower front face of the housing 31 of the recording apparatus 30 is provided with a cover 37 of an openable type, where the ejection tray 36 stored inside the housing 31 of the recording apparatus 30 is covered by the cover 37 that is closed.

Also, the upper face 31A of the housing 31 of the recording apparatus 30 is provided with an operation panel 38. The operation panel 38 includes an operation unit 39 such as a power button, and a display unit 40 composed of a liquid crystal display and the like. The display unit 40 is configured to display a menu, various types of messages, and the like. The recording apparatus 30, which is communicably coupled to a host device (not illustrated), is configured to cause, when receiving recording data from the host device, a feeding mechanism (not illustrated) to feed the paper sheet M set in the feeding tray 32, and to perform recording operation for recording an image based on the recording data on the paper sheet M having been fed.

There is provided inside the housing 31 of the recording apparatus 30, a carriage 42 equipped with a recording head 41 configured to discharge a liquid such as ink or the like onto the paper sheet M being transported in a manner reciprocally movable along an X axis (a scanning direction) orthogonal to a transport direction Td in which the paper sheet M is transported. A platen unit 300 including a platen 310 is disposed facing the recording head 41. The platen 310 supports the paper sheet M. The platen 310 and the recording head 41 define a platen gap as a distance between the platen 310 and the recording head 41. The recording apparatus 30 is configured to alternately perform, in the course that the carriage 42 moves along the scanning direction, a recording operation that the recording head 41 discharges liquid droplets to perform recording for one pass, and a transport operation of transporting the paper sheet M to the next recording position, to thus record an image or a document on the paper sheet M. Note that the transport direction Td in the embodiment coincides with a direction substantially following a direction from a−Y direction to the +Y direction.

At a front portion inside the housing 31 of the recording apparatus 30 and at one or both of portions on both sides sandwiching the ejection tray 36, there are provided installation portions (both of them not illustrated in the figure) to which liquid containers such as an ink cartridge for storing a liquid such as ink used for the recording are detachably mounted. Note that in this example, the liquid container is of an off-carriage type disposed at a position separate from the carriage 42, and the liquid container may also be of an on-carriage type that is detachably mounted on the carriage 42. Also, the recording apparatus 30 may include, without being limited to be of a serial recording type, the recording head 41 may be an elongated line head disposed across the entirety of the maximum width of the paper sheet M, and of a line recording type configured to concurrently discharge liquid droplets onto the entirety of the width of the paper sheet M.

The feeding tray 32 has a medium support structure of a three-stage structure that is constituted by a storage member 50, a first member 100, and a second member 150. The feeding tray 32 has a storage state where the storage member 50 stores the first member 100 and the second member 150, and a deployed state where the first member 100 and the second member 150 are drawn out from the storage member 50 by an operation of the user to allow the storage member 50, the first member 100, and the second member 150 to support the paper sheet M.

The feeding tray 32 is disposed at the close position, at the time when being in the storage state, to hold the feeding port 33 in the close state. When the feeding tray 32 is in the close state, the upper face of the feeding tray 32 is substantially flush with the upper face 31A of the housing 31 without forming a step. The feeding tray 32 is disposed at the open position to hold the feeding port 33 in the open state.

The ejection tray 36 is a portion at which the paper sheet M on which the recording has been performed is disposed. The ejection tray 36 has a medium support structure of a two-stage structure that is constituted by an ejection-side first member 200 and an ejection-side second member 250.

The ejection tray 36 has a storage state where the ejection-side first member 200 stores the ejection-side second member 250, and a deployed state where the ejection-side second member 250 is drawn out from the ejection-side first member 200 to allow the ejection-side first member 200 and the ejection-side second member 250 to support the paper sheet M. The ejection tray 36 is stored in the housing 31 of the recording apparatus 30 in the storage state. The ejection-side first member 200 is coupled, in a manner being drawable frontward, to the housing 31 of the recording apparatus 30. The ejection tray 36, when the ejection-side first member 200 and the ejection-side second member 250 are drawn out from the housing 31 of the recording apparatus 30 at the time when the ejection port 35 formed at the housing 31 of the recording apparatus 30 is in the open state, transitions to the deployed state.

Next, a configuration of the platen unit 300 will be described.

Figure 2:
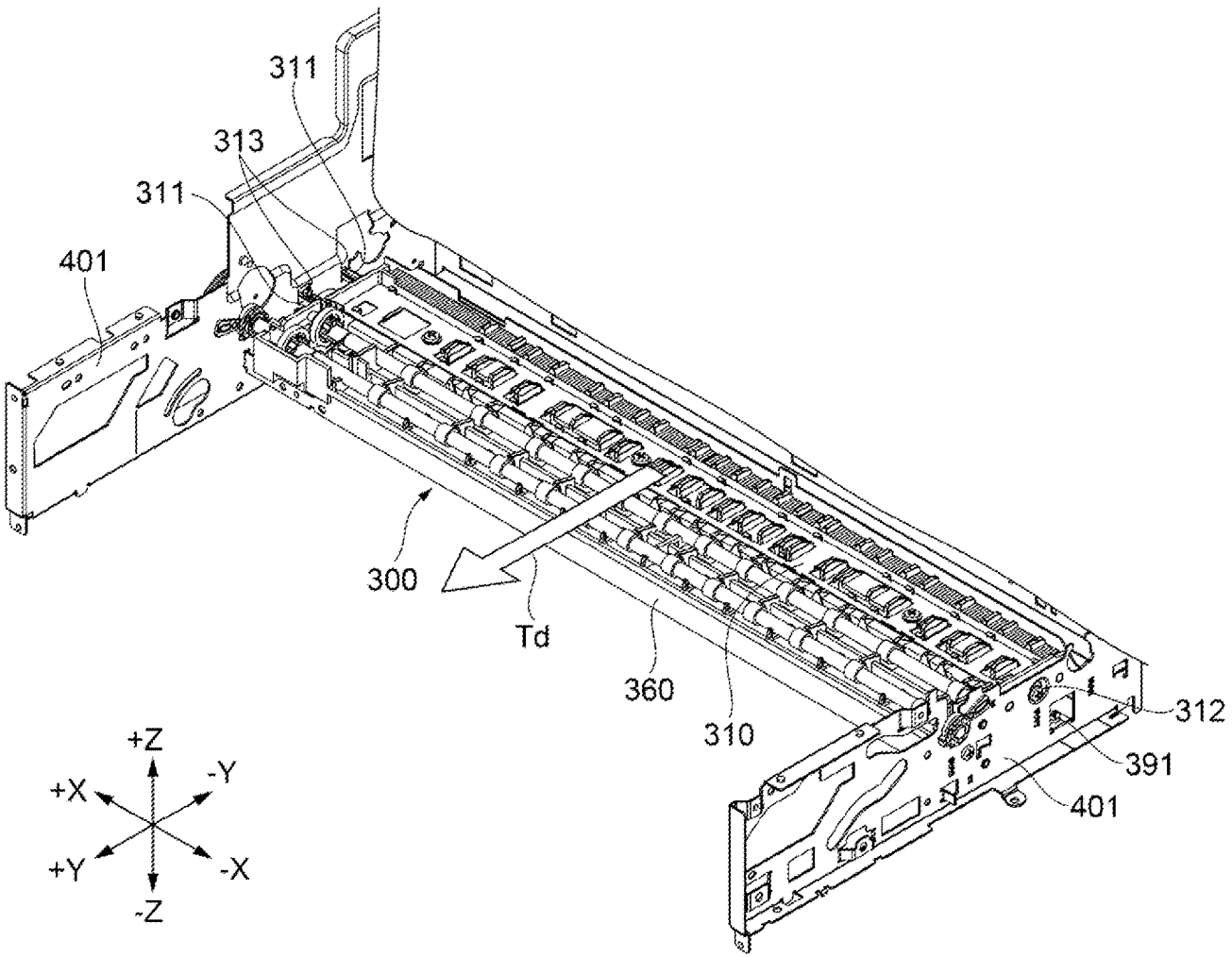
FIG. 2 is a perspective view illustrating a configuration of a platen unit.

As illustrated in FIG. 2, the platen unit 300 includes the platen 310 supporting the paper sheet M and a reinforcing member 360 supporting the platen 310. The platen 310 and the reinforcing member 360 are plate-like members that extend along the X axis. For example, the platen 310 is formed of a conductive material, and the reinforcing member 360 is formed of an iron-based material. The reinforcing member 360 has higher rigidity than the platen 310 and reinforces the platen 310 that is supported.

In addition, the recording apparatus 30 is provided with a pair of support frames 401 that support both ends of the platen 310 in a direction along the X axis, which coincides with a direction intersecting the transport direction Td, relative to the platen 310, in which the paper sheet M is transported.

Both ends of the platen 310 and the reinforcing member 360 are supported by the support frames 401, respectively. More specifically, the both ends of the reinforcing member 360 are supported by the support frames 401, respectively, in a state of being fixed by a fastening member 391.

Figure 3:
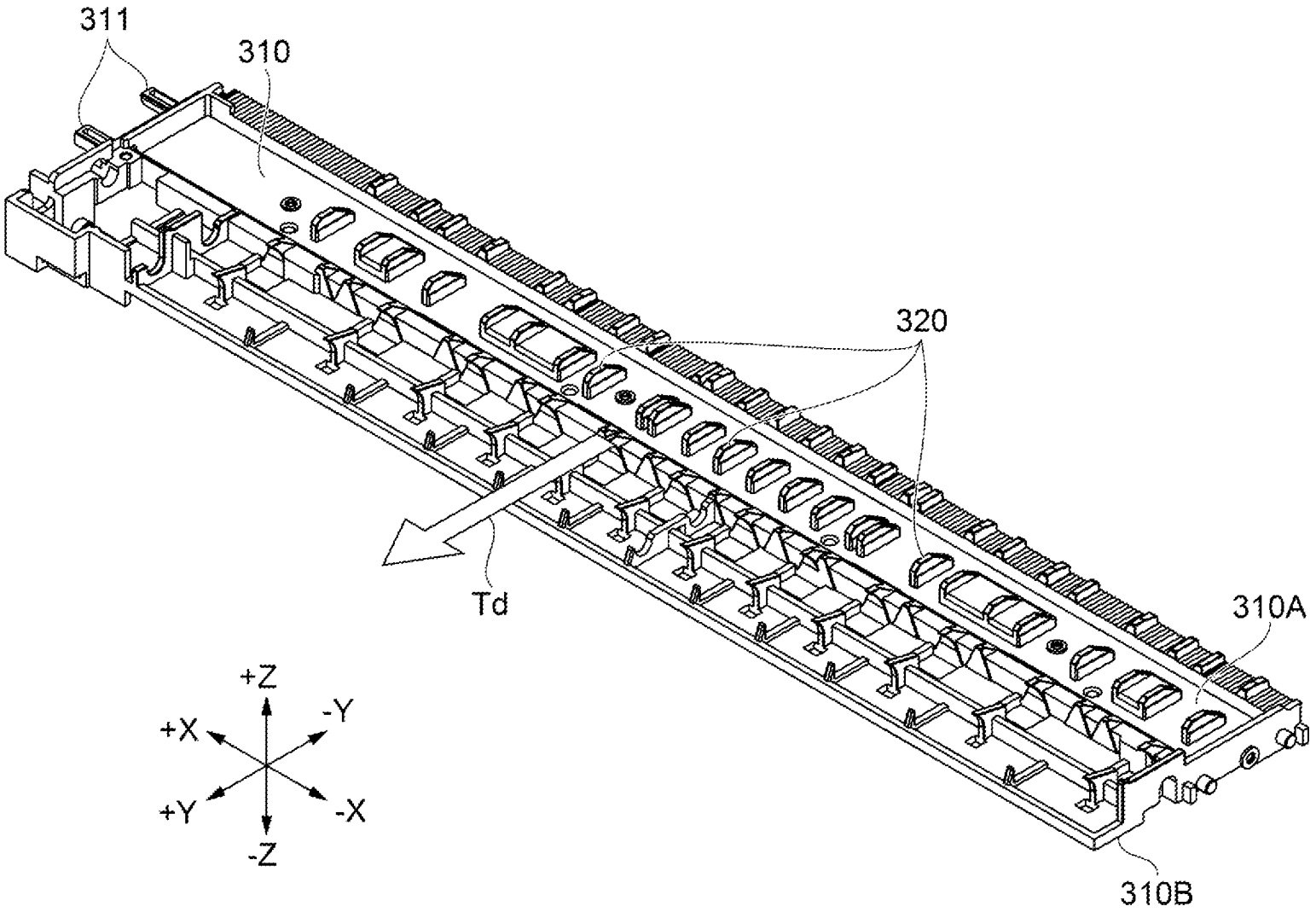
FIG. 3 is a perspective view illustrating a configuration of a platen.

Also, as illustrated in FIGS. 2 and 3, one end of the platen 310 is supported by one of the support frames 401 in a state of being fixed by a fastening member 312. On the other hand, the other end is supported in a state of not being fixed to the other of the support frames 401. Specifically, the other end of the platen 310 is provided with a projection 311 of a rod-like shape extending in a+X direction, and is supported in a state where the projection 311 is inserted through an opening 313 provided at the other of the support frames 401. This allows the other end of the platen 310 to freely move in the direction along the X axis, thus suppressing deformation such as warpage and the like even when the platen 310 expands or contracts in the direction along the X axis. This makes it possible to suitably maintain the platen gap. Note that the fastening members 312 and 391 of the embodiment are screws.

Further, a plurality of ribs 320 that support the paper sheet M are erected at a front face 310*a*, which is a face in the +Z direction of the platen 310. The ribs 320 protrude in the +Z direction, and is formed convexly protruding in a direction along the transport direction Td as the longitudinal direction. The ribs 320 are arranged at appropriate intervals in the direction along the X axis.

Figure 4:
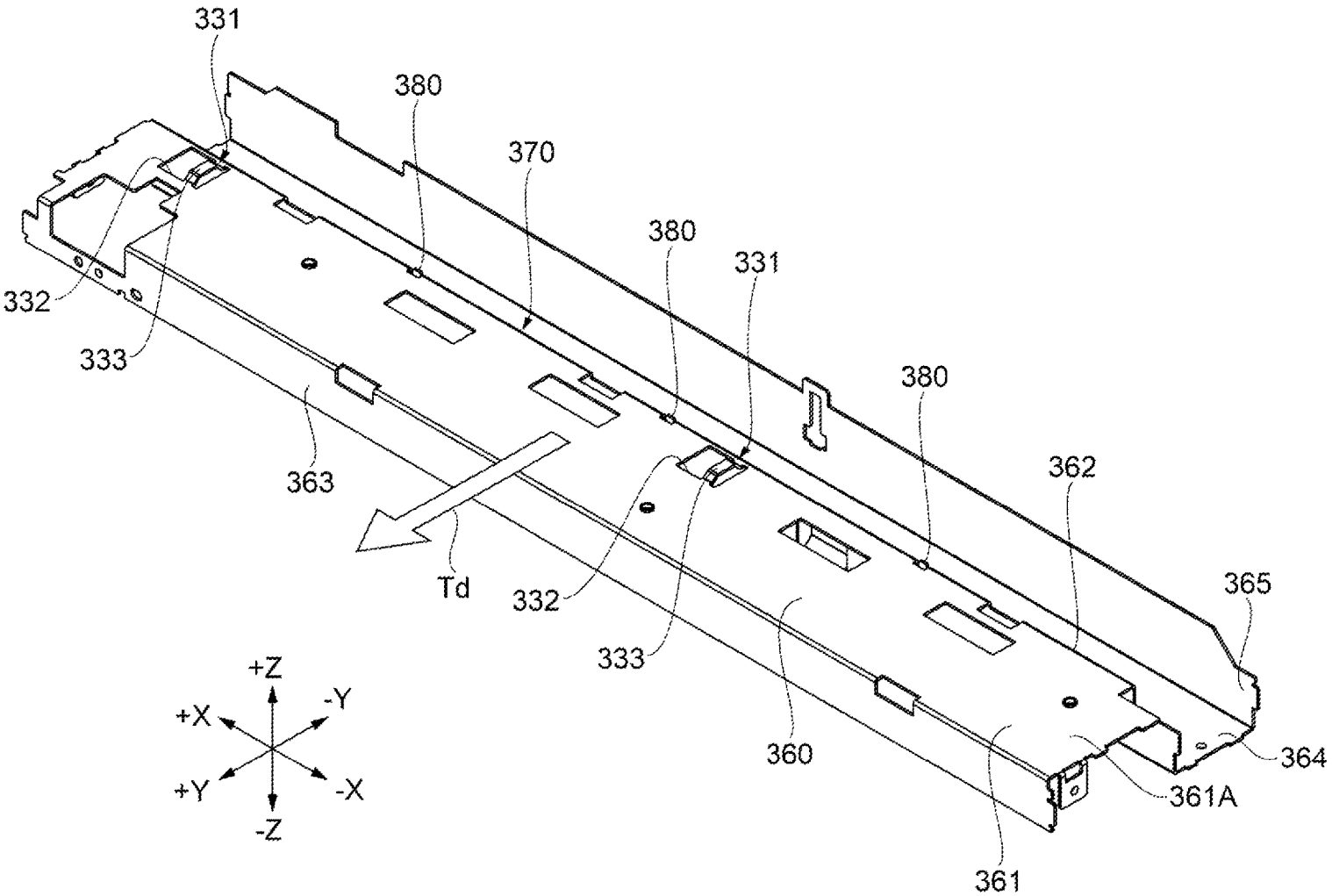
FIG. 4 is a perspective view illustrating a configuration of a reinforcing member.

As illustrated in FIG. 4, the reinforcing member 360 includes a first plate portion 361 having a first face 361A facing a back face 310B of the platen 310, and a second plate portion 362 intersecting in the transport direction Td with the first plate portion 361 and bent in a−Z direction opposite to the platen. In the embodiment, the second plate portion 362 is provided upstream in the transport direction Td of the first plate portion 361. The reinforcing member 360 of the embodiment also includes a third plate portion 363, a fourth plate portion 364, and a fifth plate portion 365, in addition to the first plate portion 361 and the second plate portion 362. Specifically, the third plate portion 363 is a plate portion bent in the −Z direction from an end portion in a+Y direction of the first plate portion 361. The fourth plate portion 364 is a plate portion bent in the −Y direction from an end portion in the −Z direction of the second plate portion 362. The fifth plate portion 365 is a plate portion bent in the +Z direction from the end portion in the −Y direction of the fourth plate portion 364. As described above, the reinforcing member 360 is configured by bending a single piece of a plate member at a plurality of locations. This enhances the rigidity of the reinforcing member 360 and suppresses the occurrence of the warpage and the like.

An edge portion 370 of a bent section between the first plate portion 361 and the second plate portion 362 is provided with a convex portion 380 protruding from a side of the first face 361A toward the platen 310. The edge portion 370 is provided along the X axis. The edge portion 370 of the embodiment is provided upstream in the transport direction Td of the first plate portion 361. In addition, a plurality of the convex portions 380 are provided at intervals along the X axis.

Figure 5:
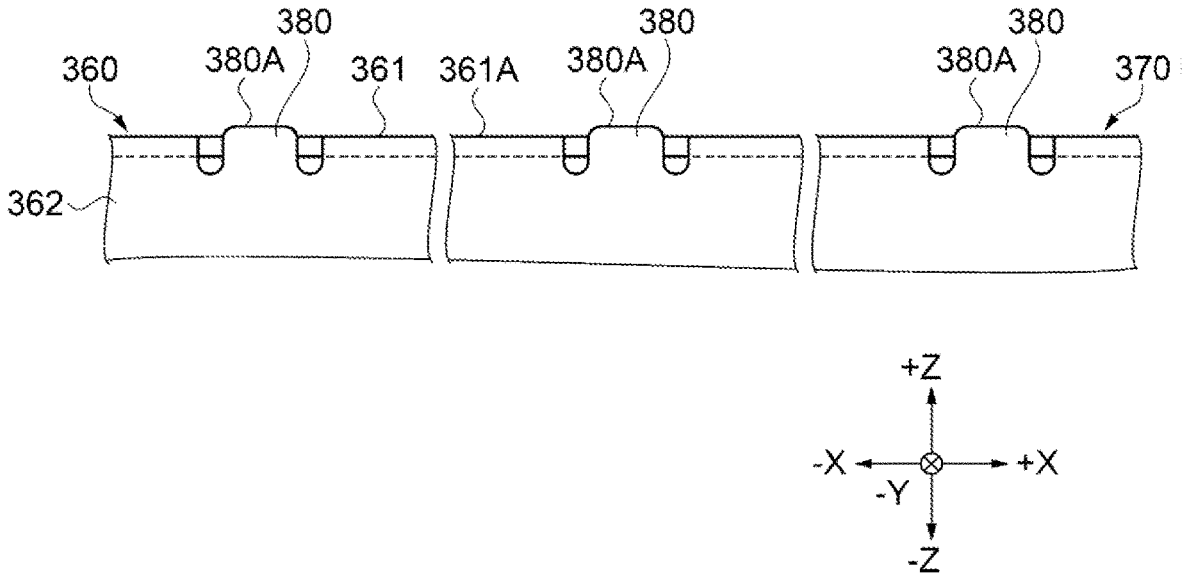
FIG. 5 is an explanatory view illustrating a configuration of a reinforcing member.

As illustrated in FIG. 5, the convex portion 380 is configured by a part of an end portion in the +Z direction of the second plate portion 362 protruding toward the platen 310. A top portion 380A of the convex portion 380 of the end portion in the +Z direction forms a flat face, where the top portion 380A is located further in the +Z direction from the first face 361A.

The convex portion 380 thus configured is formed by, for example, opening the periphery to leave a shape corresponding to the convex portion 380 at a part of a single piece of the plate member and bending the plate member at a predefined position. A portion at which the plate member is bent corresponds to the edge portion 370. This allows the convex portion 380 to be formed at the edge portion 370.

Here, a height adjustment of the top portion 380A of the convex portion 380 will be described. As described later, because the platen 310 is supported by the top portions 380A of the convex portions 380, height accuracy of the top portion 380A of the convex portions 380 that serves as the height standard counts. Thus, it is necessary to equally adjust the heights of the top portions 380A of all of the convex portions 380 that support the platen 310. That is, it is necessary to adjust a face collectively formed by the respective top portions 380A to form a horizontal face.

On the other hand, the reinforcing member 360 extends in the direction along the X axis, thus, the reinforcing member 360 may have the central portion warped, under its own weight, in a convex shape in the −Z direction, for example. In this case, the convex portions 380 also conform to the warpage of the reinforcing member 360, a height of the top portion 380A of the convex portion 380 at the central portion in the X axis falls to be lower than the height of the top portion 380A of the other convex portions 380. In this state, when the platen 310 is supported on the convex portions 380, the platen 310 has the central portion warped, under its own weight, in a convex shape in the −Z direction in conformance with the convex portions 380, resulting in a variation in the heights of the ribs 320 of the platen 310.

Figure 6:
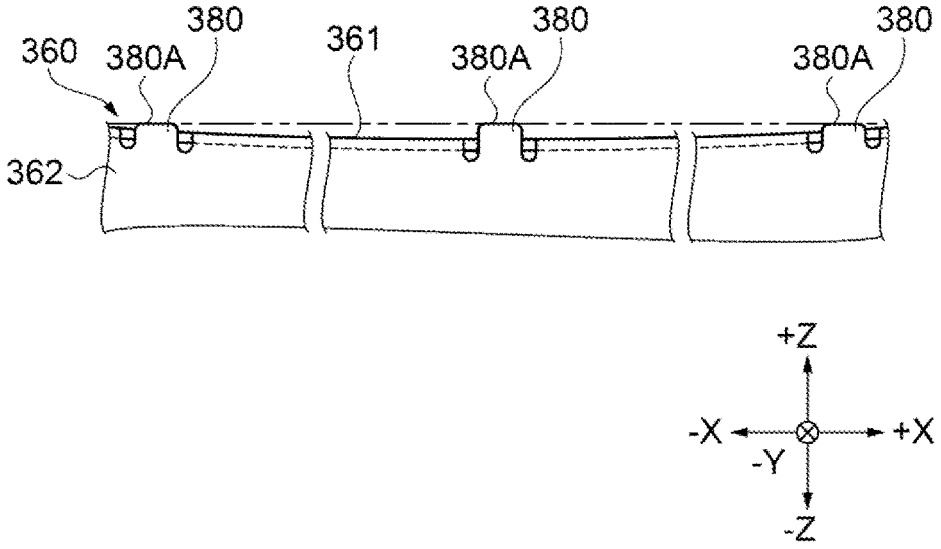
FIG. 6 is a schematic view illustrating a configuration of a reinforcing member.

Under such a circumstance, in view of the warpage of the reinforcing member 360, the heights in the +Z direction of the top portions 380A of all of the convex portions 380 that support the platen 310 are aligned with each other, as described in the example of FIG. 6. That is, the face collectively formed by the top portions 380A of all of the convex portions 380 is processed to form a horizontal face. Here, the convex portion 380 is provided at the edge portion 370. Thus, when a support face supporting the platen 310 is provided in a region other than the edge portion 370, for example, at the first face 361A of the first plate portion 361, a height of the support face supporting the platen 310 has a strong effect on the occurrence of the warpage and a spring-back in the direction along the X axis and the Y axis of the first face 361A due to residual stress after bending processing, which makes it difficult to control accuracy of the support face. On the other hand, in the embodiment, because the support face supporting the platen 310 is the top portion 380A of the convex portion 380 provided at the edge portion 370, it is sufficient to consider the effect of the warpage in an X axis direction of the reinforcing member 360 without taking deformation in conjunction with the bending processing into account. In addition, because dimensions on the X axis and the Y axis of the convex portion 380 are dimensions equivalent to a board thickness of the second plate portion 362, an area of the top portion 380A is relatively small as well. This facilitates a processing that takes the face collectively formed by the top portions 380A of all of the convex portions 380 as the horizontal face. This also facilitates a control of the height accuracy of the top portion 380A, and enhances the uniformity of the height accuracy of the top portion 380A.

Note that in the embodiment, the convex portions 380 are provided in three pieces at the reinforcing member 360, and the number of the convex portions 380 that are formed may be singular or four or more. Also, dimensions in the directions along the X axis and the Z axis of the convex portion 380 can be set as appropriate.

Figure 7:
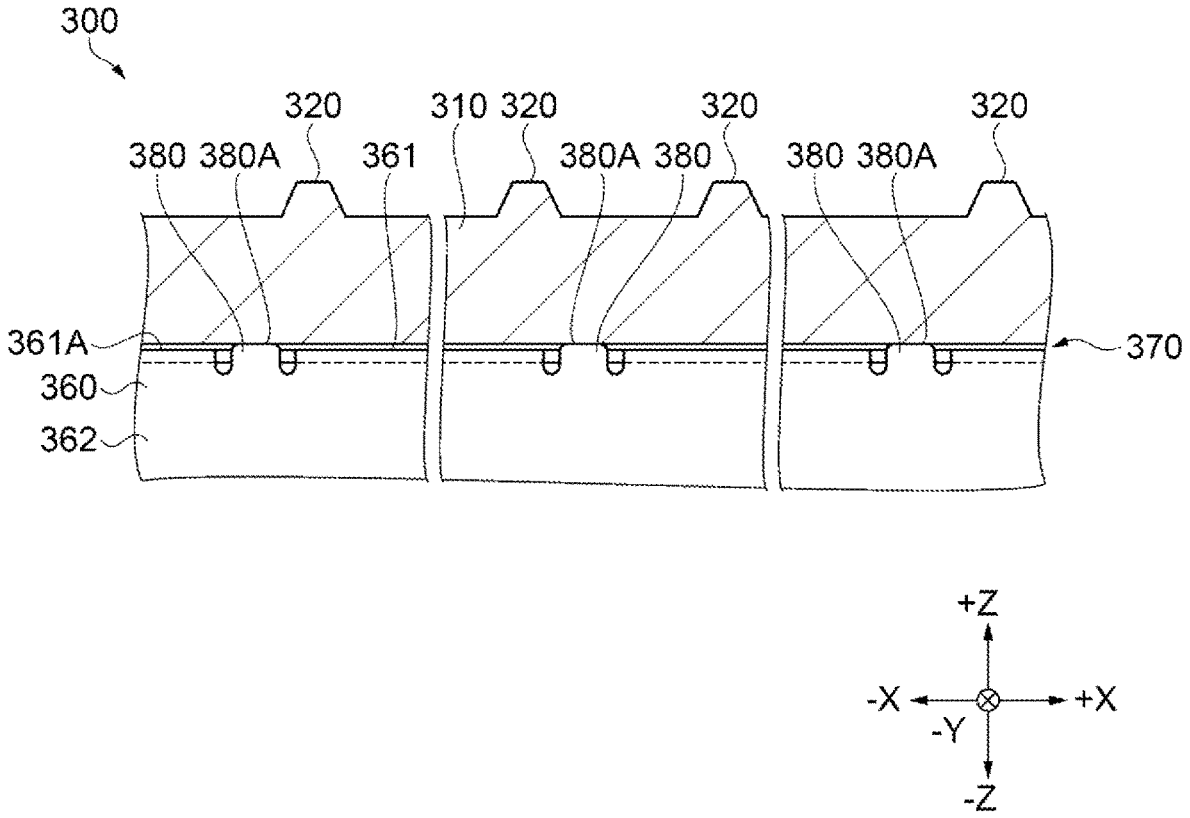
FIG. 7 is an enlarged view illustrating a configuration of a platen unit.

FIG. 7 is a partially enlarged view illustrating the configuration of the platen unit 300, and is a view illustrating the convex portion 380 in the −Y direction. As illustrated in FIG. 7, the platen 310 is supported by the top portions 380A of the convex portions 380 of the reinforcing member 360. The platen 310 is supported by the convex portions 380 in a state spaced apart from the first face 361A of the first plate portion 361. That is, a configuration is achieved in which the platen 310 is upthrusted by the convex portions 380, which easily secures accuracy in a height direction of the platen 310, facilitating height control of the platen 310.

In addition, the ribs 320 are arranged above the convex portions 380, as illustrated in FIG. 7. Specifically, when viewing the convex portions 380 in the +Z direction, the ribs 320 are arranged on an imaginary line connecting all of the convex portions 380 arranged along the X axis. This makes the height directions of the top portions of the ribs 320 uniform, facilitating accuracy control of the platen gap.

Note that the convex portion 380 of the embodiment is provided, but not limited to, at the edge portion 370 upstream in the transport direction Td of the first plate portion 361. For example, the convex portion 380 may be provided at the edge portion downstream in the transport direction Td of the first plate portion 361. Specifically, the edge portion of the bent section between the first plate portion 361 and the third plate portion 363 may be provided with the convex portion 380 protruding from the first face 361A toward the platen 310. In this case, as the convex portion 380, a part of the end portion in the +Z direction of the third plate portion 363 protrudes toward the platen 310. In addition, the convex portion 380 may be provided at each of the edge portions upstream and downstream of the transport direction Td of the first plate portion 361. This also makes it possible to achieve advantageous effects similar to those described above.

Next, an engagement structure between the platen 310 and the reinforcing member 360 will be described.

Figure 8:
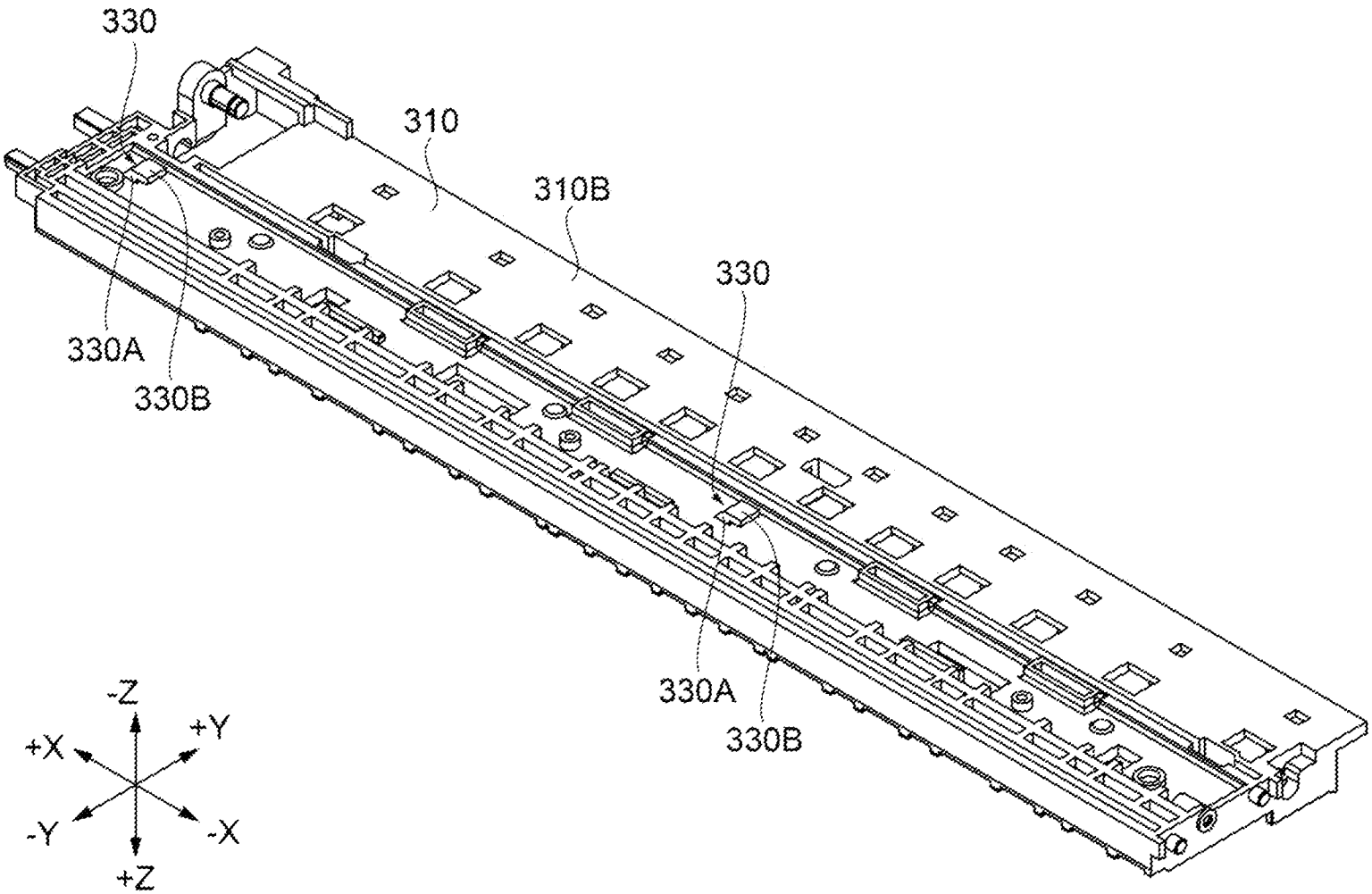
FIG. 8 is a perspective view illustrating a configuration of a hook portion of a platen.

FIG. 8 is a perspective view of the platen 310 viewed from a side of the back face 310B. As illustrated in FIG. 8, a hook portion 330 is provided at the back face 310B, which is a face on a side of the reinforcing member 360 of the platen 310.

The hook portion 330 is formed in a hook-like shape that is bent in the middle, and constituted by a first protrusion 330A protruding in the −Z direction and a second protrusion 330B protruding from a tip end portion in a−X axis direction of the first protrusion 330A. In the embodiment, the plurality of the hook portions 330 are arranged at intervals in the direction along the X axis.

Further, as illustrated in FIG. 4, the first face 361A of the reinforcing member 360 is provided with an engaged portion 331 that is engageable with the hook portion 330. Specifically, the engaged portion 331 is constituted by an opening 332 passing through the first plate portion 361 and a bridge portion 333 that is bridged over the opening 332 along the Y axis. The engaged portion 331 is provided at a position corresponding to the hook portion 330.

Figure 9:
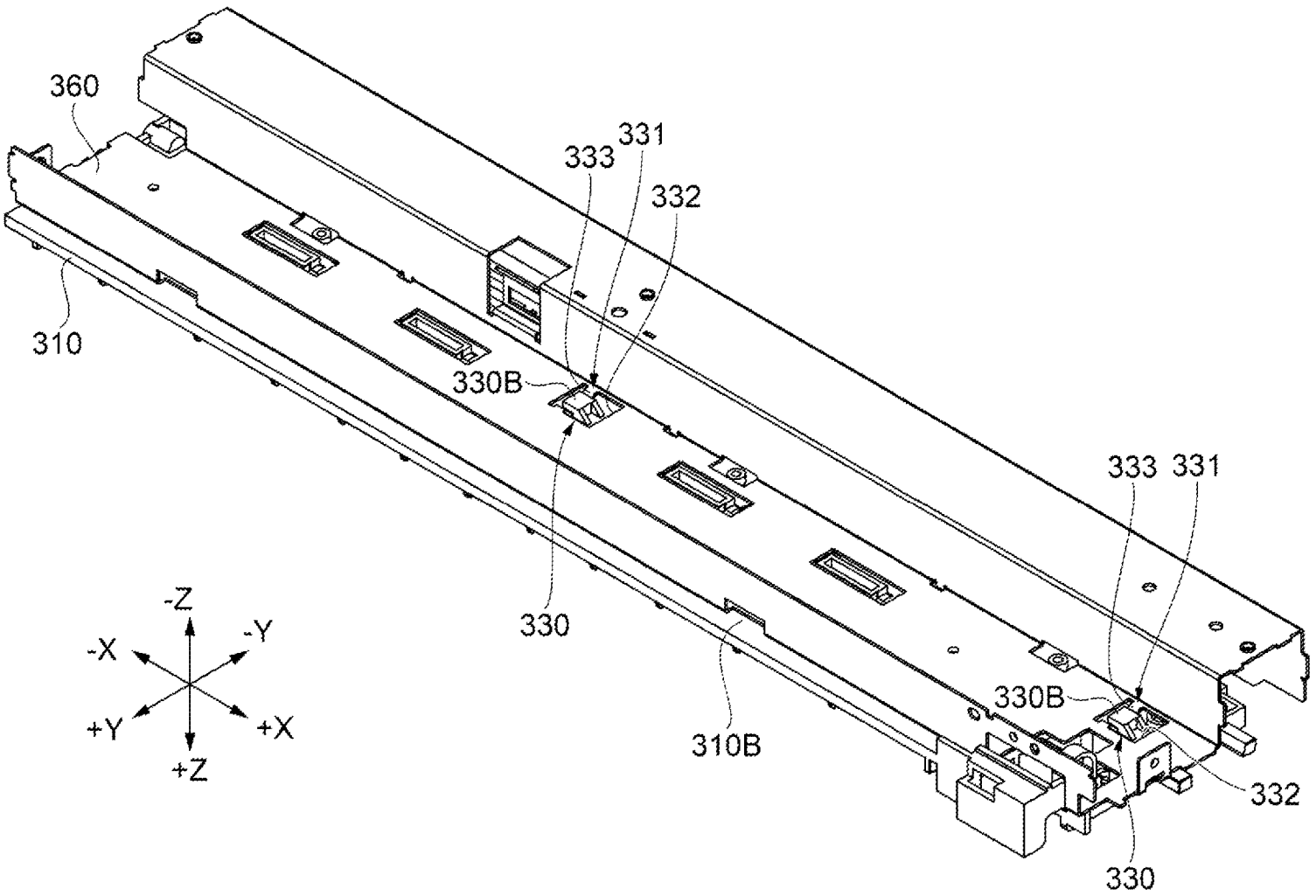
FIG. 9 is a perspective view illustrating an engagement state of the platen and the reinforcing member.

Then, when the platen 310 is engaged with the reinforcing member 360, the hook portion 330 is passed through the opening 332 of the reinforcing member 360 to make the platen slid in a−X direction relative to the reinforcing member 360, as illustrated in FIG. 9. This allows the bridge portion 333 to be located between the back face 310B of the platen 310 and the second protrusion 330B, making the platen 310 easily engaged with the reinforcing member 360.

That is, in a state where the platen 310 and the reinforcing member 360 are not supported by the pair of support frames 401, the hook portion 330 becomes engageable with the engaged portion 331 in a state making contact with each other in the gravitational direction. Specifically, the bridge portion 333 comes into contact with the second protrusion 330B in the gravitational direction. This makes it hard, during assembly of the apparatus, to separate the platen 310 from the reinforcing member 360, which enables to prevent the platen 310 or the reinforcing member 360 from dropping, facilitating handling operation.

Figure 10:
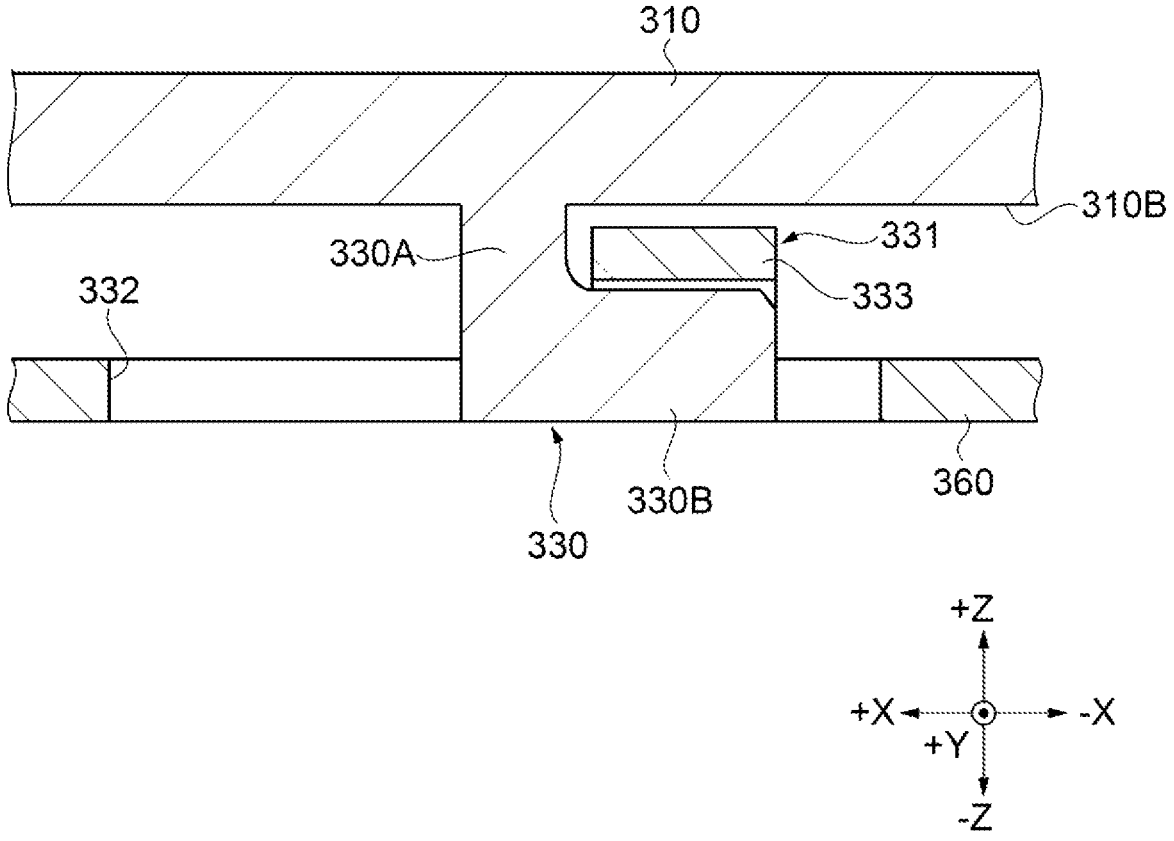
FIG. 10 is a partially enlarged view illustrating a positional relationship between a hook portion and an engaged portion.

On the other hand, FIG. 10 illustrates a state where the platen unit 300 is supported by the pair of support frames 401. In a state where the platen 310 and the reinforcing member 360 are supported by the pair of support frames 401, the hook portion 330 and the engaged portion 331 are supported by the pair of support frames 401 in a state of not making contact with each other in the gravitational direction. That is, although the bridge portion 333 is located between the back face 310B of the platen 310 and the second protrusion 330B, the bridge portion 333 makes contact with none of the back face 310B or the second protrusion 330B in the gravitational direction and the platen 310 and the reinforcing member 360 do not interfere with each other. Thus, even when, for example, the reinforcing member 360 is warped, the platen 310 is not affected by the warpage of the reinforcing member 360. This makes it possible to secure accuracy in the height direction of the platen 310.

What is claimed is:

1. A recording apparatus, comprising:

a recording head configured to discharge a liquid onto a medium being transported in a transport direction, a platen disposed facing the recording head, and supporting the medium at a front face side, and a reinforcing member of a plate-like shape supporting the platen, wherein the reinforcing member includes a first plate portion having a first face facing a back face of the platen, and a second plate portion bent, with respect to the first plate portion, in a direction intersecting the transport direction and opposite to the platen, wherein a convex portion protruding from a side of the first face toward the platen is provided at an edge portion of a bent section between the first plate portion and the second plate portion, and the platen is supported at a top portion of the convex portion.

2. The recording apparatus according to claim 1, wherein the edge portion is provided upstream in the transport direction of the first plate portion, and a rib that supports the medium is provided at the front face side of the platen, wherein the rib is disposed upward of the convex portion at the same position as the convex portion with respect to the transport direction.

3. The recording apparatus according to claim 1, wherein a pair of support frames that support both ends of the platen are provided in a direction, from the platen, intersecting the transport direction, wherein one end of the both ends of the platen is supported, in a state of being fixed, by one of the support frames, while the other end is supported, in a state of not being fixed, by the other of the support frames.

4. The recording apparatus according to claim 3, wherein a hook portion is provided at the back face of the platen, and an engaged portion engageable with the hook portion is provided at the first face of the reinforcing member, wherein in a state where the platen and the reinforcing member are not supported by the support frames, the hook portion becomes engageable with the engaged portion in a state of being in contact with each other in the gravitational direction, while in a state where the platen and the reinforcing member are supported by the support frames, the hook portion and the engaged portion are supported in a state of not being in contact with each other in the gravitational direction.

* * * * *